US011396882B2

(12) United States Patent
Kacin

(10) Patent No.: US 11,396,882 B2
(45) Date of Patent: Jul. 26, 2022

(54) GAS SEAL COLUMN PUMP

(71) Applicant: William Louis Kacin, Northport, NY (US)

(72) Inventor: William Louis Kacin, Northport, NY (US)

( * ) Notice: Subject to any disclaimer, the term of this patent is extended or adjusted under 35 U.S.C. 154(b) by 0 days.

(21) Appl. No.: 17/002,869

(22) Filed: Aug. 26, 2020

(65) Prior Publication Data

US 2021/0088052 A1 Mar. 25, 2021

Related U.S. Application Data

(60) Provisional application No. 62/973,219, filed on Sep. 20, 2019.

(51) Int. Cl.

| | |
|---|---|
| ***F04D 29/10*** | (2006.01) |
| ***F04D 13/02*** | (2006.01) |
| ***F04D 29/046*** | (2006.01) |
| ***F04D 29/12*** | (2006.01) |

(52) U.S. Cl.

CPC ..... *F04D 29/122* (2013.01); *F04D 13/021* (2013.01); *F04D 29/046* (2013.01); *F04D 29/102* (2013.01)

(58) Field of Classification Search

CPC .... F04D 29/102; F04D 29/104; F04D 29/108; F04D 13/021; F04D 15/02; F04D 15/0281; F04D 29/046; F04D 29/124; F04D 29/128

See application file for complete search history.

(56) References Cited

U.S. PATENT DOCUMENTS

| | | | | |
|---|---|---|---|---|
| 1,999,163 A * | 4/1935 | Allen | F04D 7/04 | 415/105 |
| 2,764,943 A * | 10/1956 | Peters | F04D 29/061 | 417/372 |
| 3,513,942 A * | 5/1970 | Sato | F04D 29/049 | 184/6 |
| 3,746,472 A * | 7/1973 | Rupp | H02K 5/132 | 417/9 |
| 4,065,232 A * | 12/1977 | Stratienko | F04D 29/086 | 417/368 |
| 4,655,681 A * | 4/1987 | Mori | F04D 29/2266 | 415/100 |
| 4,990,068 A * | 2/1991 | Zhong | F04D 13/0626 | 417/423.8 |
| 6,582,185 B2 * | 6/2003 | Lippert | F04D 29/104 | 415/58.4 |

* cited by examiner

*Primary Examiner* — Richard A Edgar
*Assistant Examiner* — Jason G Davis
(74) *Attorney, Agent, or Firm* — John L. Sotomayor

(57) ABSTRACT

The gas seal column pump may comprise a pump drive, a gas seal column, a seal gas control box, and a pump. A drive motor of the pump drive, the gas seal column, and the pump may comprise a hermetically sealed, vertically-oriented, pumping system where the gas seal column is operable to replace mechanical seals around a drive shaft that couples the drive motor to the pump. A pressurized seal gas pumped into the drive motor and the gas seal column may displace corrosive fumes and the product being pumped. A product level may be sensed using a plurality of level sensors. Responsive to inputs from the level sensors, a seal gas control box may regulate the pressure of the seal gas using a plurality of valves. A bearing shaft adapter may be added to provide a special drive shaft of other lengths, diameters, or materials.

7 Claims, 2 Drawing Sheets

GAS SEAL COLUMN PUMP

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

CROSS-REFERENCE TO RELATED APPLICATION

This application claims the benefit of U.S. Provisional Application No. 62/973,219 filed Sep. 20, 2019, entitled "Gas Seal Column Pump".

BACKGROUND

In the pumping world dominated by horizontal pumps of all different styles, mechanical seals or shaft packing glands are the most troublesome and highest maintenance cost items over all other pump components.

SUMMARY OF THE INVENTION

The answer to eliminating these problems and their associated expenses is to remove both components and reposition the pump components vertically with a gas seal column encasing a drive shaft between a drive motor and a pump. The drive motor, the gas seal column, and the pump may form a hermetically sealed unit that is pressurized for product containment.

These numerous benefits, and other numerous benefits listed herein, may be realized by utilizing the invention:

- With a gas seal column there is no contact between rotating and stationary components of the pump, thereby allowing for a continuous run dry capability. Run dry capability may result in the elimination of friction, heat, mechanical wear, power loss, high initial cost, installation cost, replacement cost, and collateral damage cost of mechanical seal and packing when they inevitably fail and Significantly reduces the possibility of product leakage requiring cleanup and reporting to an oversight or authoritative body.
- A gas seal column, through the use of product monitoring sensors, also allows for continuous timely product control, reporting, operator alerting, and, if needed, controlled automatic shutdown of pumping operations to prevent equipment and collateral damage. In contrast, seal and packing failures may announce themselves with a large puddle on the floor.
- Combining a gas seal column with hermetically sealing all components of the pumping system together allows for:
  - Improved internal atmosphere control to prevent corrosion of internal components, especially motor bearings.
  - Improved product control with essentially no possibility of product escaping the containment envelope, possibly causing employee injury or nearby equipment damage.
  - In many cases eliminating the cost of a bearing pedestal by using a hermetically sealed extended shaft motor with a corrosion resistant sleeve to protect the extended motor shaft.

Considering all of the above it can easily be expected that the total life cycle cost of a gas seal column pump will be significantly lower than for a similar performing mechanical seal or packing pump.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
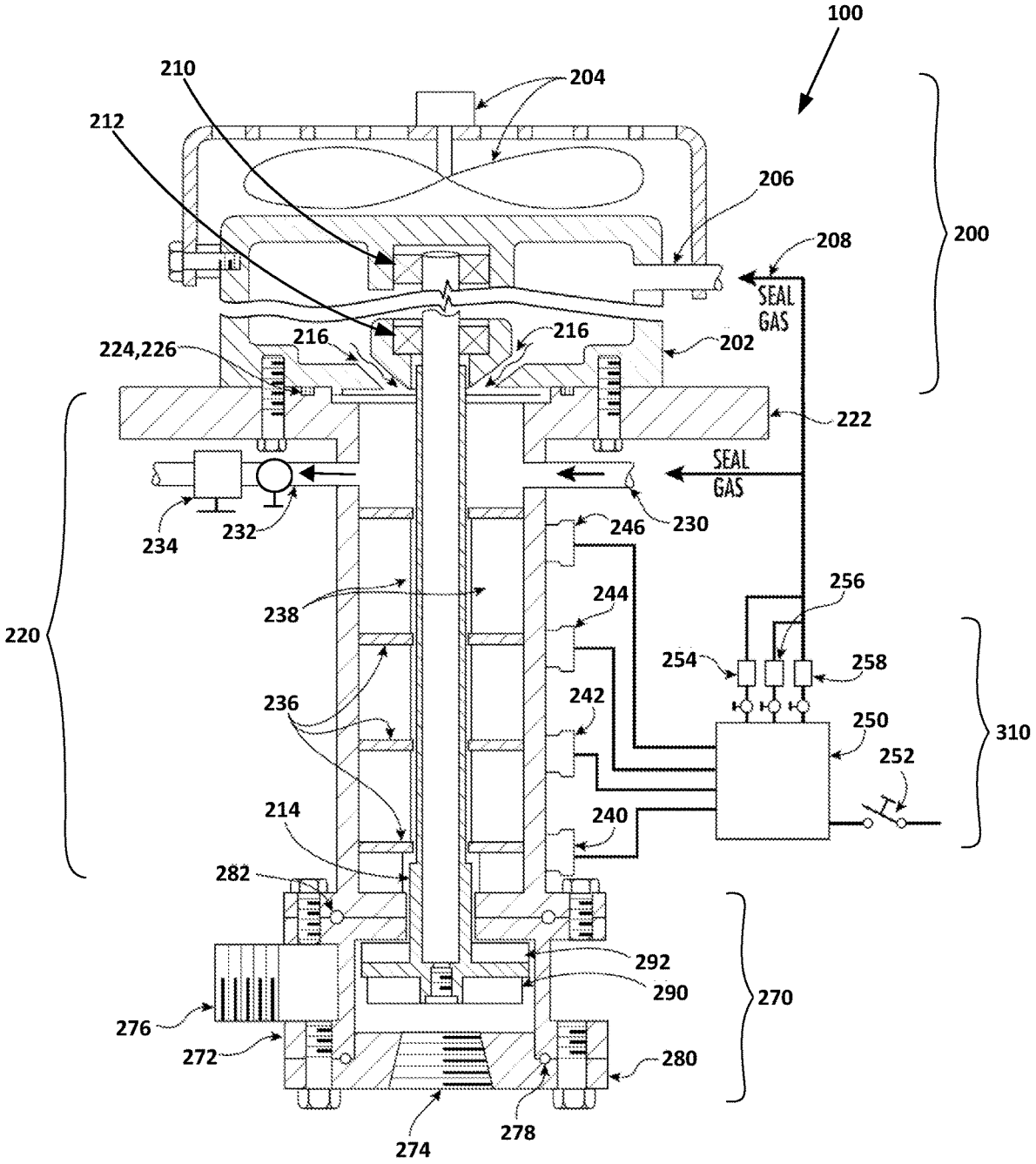
FIG. 1 is a cross-sectional view of a hermetically sealed gas seal column pump consistent with certain embodiments of the present invention and illustrating a pump drive, a gas seal column, a seal gas control box, and a pump.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The gas seal column pump (hereinafter invention) may comprise a pump drive, a gas seal column, a seal gas control box, and a pump. The pump drive may comprise a drive motor and a cooling fan. The drive motor may comprise a drive shaft that is extended to reach the pump through the gas seal column. The drive motor may further comprise a pressurized housing. The cooling fan may be coupled to the drive motor externally to cool the drive motor instead of driving a fan from an extension of the drive shaft of the drive motor through the top of the drive motor. Alternatively, ducted cooling from a remote source may be used to cool the drive motor.

The drive motor may comprise a gas inlet pipe for a seal gas to be introduced into the drive motor adjacent to an upper motor bearing. The drive motor may further comprise a plurality of gas outlet ports located adjacent to a lower motor bearing for the seal gas to exit the drive motor while protecting the lower motor bearing.

The seal gas may be clean and pressurized and may be sourced locally or remotely. The first choice for the seal gas would be clean air that is free of corrosive fumes. Alternatively, a specialized gas may be used if air is incompatible with a product being pumped. If the seal gas that is selected to be used cannot be released to the environment after use because of cost, toxicity, contamination, or other reasons then the seal gas may be directed to a local gas treatment system or collected in a tank for later treatment. After treatment, the seal gas may be reused or disposed of.

The gas seal column may be operable to encase the drive shaft component of the pumping system and may function as a replacement for mechanical seals and packing by using pressure of the seal gas to control a product level within the gas seal column, when pumping or in standby, when gas seal column controls are activated.

The gas seal column may comprise a mounting panel at the top end of the gas seal column. A circular groove in the mounting panel may capture a first O-ring which is operable to pressure seal the interface between the drive motor and the gas seal column.

An inlet pipe connection and an outlet pipe connection located in the upper quarter of the gas seal column may allow the seal gas to flow in and out of the gas seal column. A purge gas valve and a purge gas discharge valve may control the flow of the seal gas. The seal gas may flow constantly through the drive motor to keep out the corrosive fumes given off by the product.

The gas seal column may comprise a plurality of splash quieting discs. In a preferred embodiment there may be four splash quieting discs. The gas seal column may further comprise a plurality of anti-rotation panels. In a preferred embodiment there may be two sets of anti-rotation panels. The decision to use the plurality of splash quieting discs and/or the plurality of anti-rotation panels or a combination of both may be dictated by the application.

The gas seal column may comprise a plurality of level sensors. The plurality of level sensors may detect the product level within the gas seal column and may report the product level to the seal gas control box. Based upon input from the plurality of level sensors, the seal gas control box may be adapted to monitor the product level, may report the product level, may alert an operator, and may control the product level of the product that may come into the gas seal column during operating or non-operating conditions, when the seal gas control box is energized by a purge gas control switch. As a non-limiting example, the seal gas control box may be adapted to alert the operator by activating flashing indicators, sending text messages, pages, or emails, sounding audible transducers, or combinations thereof if the product level exceeds a predetermined alert threshold. As a further non-limiting example, the seal gas control box may shut down the pump and possibly other components if the product level exceeds a predetermined shutdown threshold.

In a preferred embodiment there may be four level sensors. In some embodiments, the four level sensors may be equally spaced along the gas seal column. A first level sensor may be located at the lowest level of the gas seal column. A second level sensor, a third level sensor, and a fourth level sensor may be located above the first level sensor in that order, with the fourth level sensor being at the highest level within the gas seal column.

At pump start up, the purge gas control switch may be activated manually or automatically. Responsive to activating of the purge gas control switch, the seal gas control box may begin a low volume purge gas flow throughout the system by opening a purge gas valve and leaving a first gas valve and a second gas valve closed. In some embodiments, the opening and closing of the purge gas valve, the first gas valve, a second gas valve, and the gas discharge valve may be controlled by relays or other controls located within the seal gas control box.

In some embodiments, the purge valve, the first gas valve, and the second gas valve may provide differing flow rates of the seal gas when in the open state. The differing flow rates may result in differing pressures applied to the product within the gas seal column. The smallest flow rate, and therefore the lowest pressure on the product within the gas seal column, may result from having only the purge valve open. The highest flow rate, and therefore the highest pressure on the product within the gas seal column, may result from having the purge valve, the first gas valve, and the second gas valve all open. Because the seal gas may be introduced into the top of the gas seal column, the pressure applied to the product from the seal gas may work to force the product level down.

The seal gas control box may become aware that the product has entered the gas seal column when the first level sensor detects the product and opens the purge gas valve. If the product is detected by the second level sensor, the seal gas control box may attempt to stop the product from rising further in the gas seal column by increasing the pressure of the seal gas within the gas seal column. The seal gas control box may open the first gas valve, thus releasing a higher flow of the seal gas into the drive motor and into the gas seal column. If this works and the product level drops then the second level sensor may reflect that the product is no longer contacting the second level sensor. However, the seal gas control box may retain the first gas valve in the open state. When the first level sensor indicates that the product level has dropped below the first level sensor, the seal gas control box may close the first gas valve, the purge gas valve, and the gas discharge valve.

Alternatively, if the product level continues to rise above the second level sensor and is detected by the third level sensor, the seal gas control box may activate and latch a relay that opens the second gas valve, thus releasing an even higher flow of gas into the drive motor and the gas seal column to further increase gas pressure to push the product down in the gas seal column. The seal gas control box may additionally be adapted to send an alert to the operator reporting that the product is appearing at a higher level in the gas seal column than is normally expected. The higher level of gas flow will continue until the product is driven down to the first level sensor which will open and deactivate the two latched relays that will then close the first gas valve, the second gas valve, the purge gas valve, and the gas discharge valve.

Alternatively, if the product level continues to rise and is detected by the fourth level sensor, the seal gas control box may be adapted to initiate a controlled, complete shutdown of the system and close all valves to maintain the hermetically sealed integrity of the total pump housing and to prevent equipment damage or other collateral damage from occurring. This shutdown sequence allows the operator to investigate what is causing the condition and to correct the problem.

The first level sensor may be located slightly above the minimum priming level for the pump. When the pump is stopped, inlet or outlet conditions may cause the product to rise or drop in the gas seal column. A rise in the product level may be controlled as previously described. Responsive to a drop in the product level below the first level sensor, the seal gas control box may deactivate the relay that holds the purge valve open. Closing the purge valve may stop purge gas flow until the product rises to reach the first level sensor. The seal gas control box may function in this manner whether the pump is operating or in standby mode as long as the seal gas control box is activated.

The description of sensing and control presented herein is by way of illustration only. There are many other sensing and control techniques that may be applied which a person having ordinary skill in the art will recognize as falling within the spirit and scope of the invention.

The pump illustrated is a centrifugal pump comprising a pump casing with an inlet and an outlet and a second O-ring to seal a cover plate to the pump casing. The pump casing may be hermetically sealed to the gas seal column with a third O-ring, completing the hermetic seal for the entire assemblage. The drive motor, the gas seal column, and the pump may comprise a single, hermitically sealed unit.

The pump may comprise a dual impellor to move the product. An auxiliary impellor may be mounted on the back of a main impellor. The auxiliary impellor may be a larger diameter than the main impellor. The auxiliary impellor may constitute a hydrodynamic shaft seal and may prevent the flow of the product into the gas seal column during pumping operations. The auxiliary impellor may not be needed for all applications and may therefore be optional.

The drive shaft may be a sleeved shaft to protect the drive shaft from corrosion.

The pumping system shown in FIG. 1 using the drive motor comprising an extended shaft is for illustration only. A person having ordinary skill in the art will recognize that various arrangements of the drive shaft may fall within the spirit and scope of the invention as long as the drive motor is coupled to the pump via the gas seal column.

Figure 2:
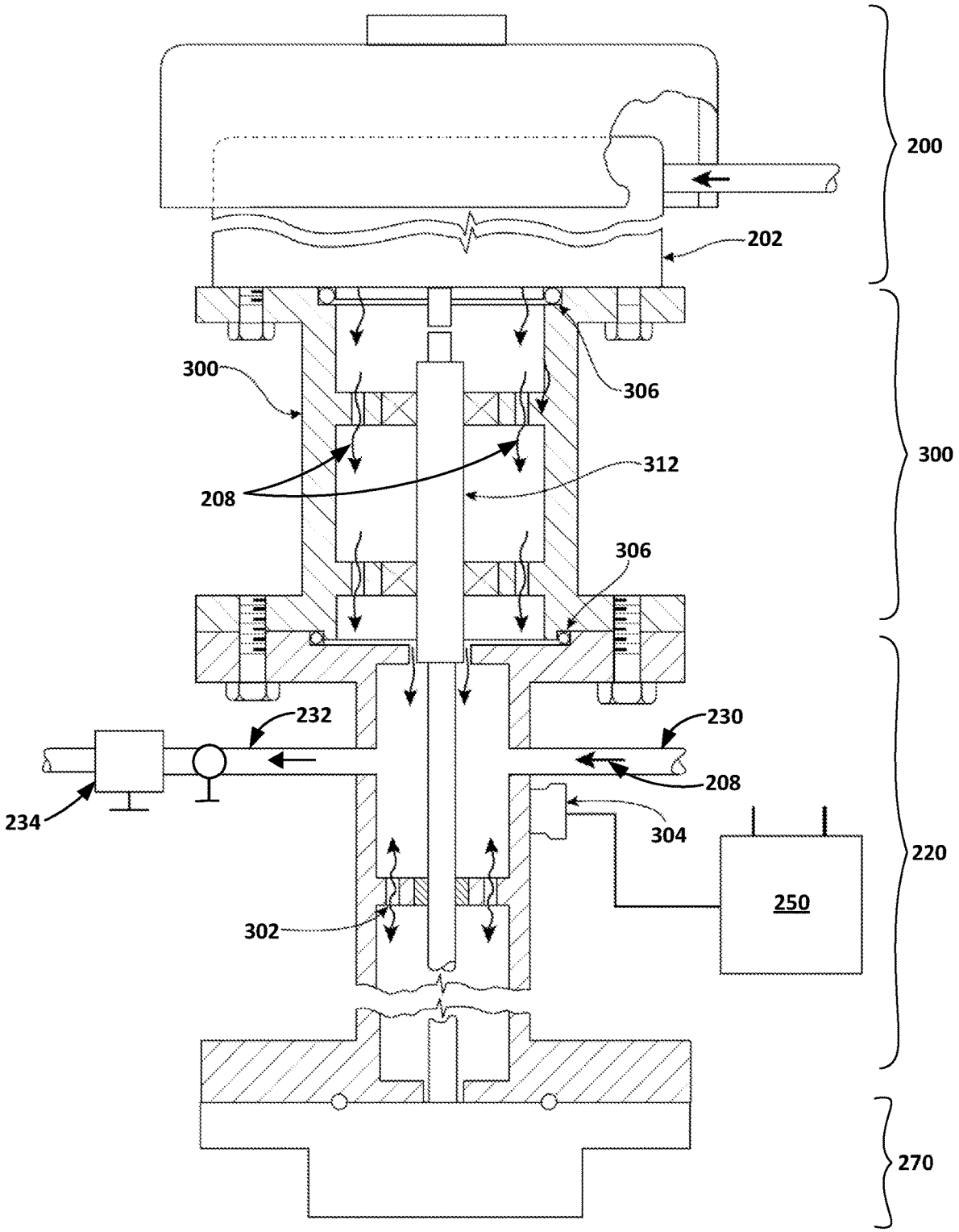
FIG. 2 is a cross-sectional view of a hermetically sealed gas seal column pump consistent with certain embodiments of the present invention and illustrating a bearing shaft adapter used in conjunction with a pump drive, a gas seal column, and a pump.

Referring to FIG. 2, some applications may require a special shaft of length, diameter, or material of construction not available in an extended shaft drive motor. Applications requiring the drive shaft and the gas seal column to be longer may be accomplished by using a bearing shaft adapter between the drive motor and the gas seal column. The bearing shaft adapter may couple and seal to both the drive motor and the gas seal column such that the assemblage of the drive motor, the bearing shaft adapter, the gas seal column, and the pump are hermetically sealed. The gas seal column may be of any practical length and designed with a plurality of shaft bearing supports and level sensors along the length of the gas seal column to satisfy the requirements of the application.

The bearing shaft adapter interfaces may be sealed by an additional O-rings to maintain the hermetic seal integrity of the pump envelope.

Since a hermetically sealed unit encloses a fixed volume of empty space, the hermetically sealed unit passively assists in controlling the level of the product trying to rise in the gas seal column. Passive assistance may result from Boyles Law which states that "the pressure of an ideal gas is inversely proportional to the volume of the ideal gas at a constant temperature".

$$P1 \times V1 = P2 \times V2$$

where P1 is a first pressure,

V1 is a first volume,

P2 is a second pressure, and

V2 is a second volume.

Simply put—if you halve the available volume of a fixed amount of gas you will double the pressure. As a non-limiting example, when the product rises within the gas seal column, the volume available to the seal gas is reduced. In accordance with Boyle's Law, as the volume of the seal gas is reduced, the pressure of the seal gas increases and the seal gas may become more effective in countering the rise of the product.

As experience is gained through the introduction and application of this invention consideration should be given to the operational benefits that might be optimized by decreasing empty space in the motor housing and also the internal shape and size of the gas seal column around the drive shaft, all of which may affect system response time.

Turning now to FIG. 1, a cross section of the invention 100 through the pump drive 200, the gas seal column 220, and the pump 270 is shown. The pump drive 200, the gas seal column 220, and the pump 270 may be hermitically sealed to each other. As non-limiting examples, the circular groove 224 on the mounting panel 222, the first O-ring 226, the second O-ring 278, the cover plate 280, the pump casing 272, and the third O-ring 282 may prevent air, the seal gas 208, and the product from leaking in or out. The pump drive 200 may comprise the drive motor 202 and the cooling fan 204.

The gas seal column controls 310, comprising the seal gas control box 250, the purge valve 254, the first gas valve 256, and the second gas valve 258, may control the flow of the seal gas 208 into the invention 100 when activated by the purge gas control switch 252. The seal gas 208 may be introduced into the drive motor 202 via the gas inlet pipe 206 such that the seal gas 208 may protect motor bearings. As non-limiting examples, the seal gas 208 may protect the upper motor bearing 210 and the lower motor bearing 212. The seal gas 208 may exit from the drive motor 202 via the plurality of gas outlet ports 216.

The seal gas 208 may also flow into the gas seal column 220 via the inlet pipe connection 230 and may exit the gas seal column 220 via the outlet pipe connection 232. The seal gas 208 may pressurize the gas seal column 220 to force the product downwards. The pressure may be regulated by the seal gas control box 250 by opening and closing the purge valve 254, the first gas valve 256, and the second gas valve 258. The gas discharge valve 234 may prevent or permit the seal gas 208 from exiting the gas seal column 220 and may also be under control of the seal gas control box 250. The seal gas control box 250 may also control power to the drive motor 202 such that the seal gas control box 250 may shut down the system if necessary.

The first level sensor 240, the second level sensor 242, the third level sensor 244, and the fourth level sensor 246 may detect the product level within the gas seal column 220 and may report the product level to the seal gas control box 250.

The drive shaft 214 may turn the main impellor 290 in the pump 270 to move the product from the inlet 274 to the outlet 276. The auxiliary impellor 292 may be coupled to the main impellor 290 and may constitute a hydrodynamic seal to resist the flow of the product into the gas seal column 220. The gas seal column 220 may comprise the plurality of anti-rotation panels 238 and the plurality of splash quieting discs 236.

Turning now to FIG. 2, a cross section of the invention 100 through the pump drive 200, the gas seal column 220, the bearing shaft adapter 300, and the pump 270 is shown. The bearing shaft adapter 300 may permit the introduction of the special shaft 312 when necessary. As a non-limiting example, the additional O-rings 306 may hermitically seal the bearing shaft adapter 300 to the drive motor 202 and the gas seal column 220. The plurality of level sensors 304 may detect the product level within the gas seal column 220 and may report the product level to the seal gas control box 250 as in FIG. 1. The seal gas 208 may flow through the invention 100 as described in FIG. 1. As a non-limiting example, the seal gas 208 may enter the gas seal column 220 via the inlet pipe connection 230 and exit at the outlet pipe connection 232 as permitted by the gas discharge valve. The seal gas 208 may flow through the plurality of shaft bearing supports 302 to push the product level down to whatever product level is required for the gas seal column 220.

While certain illustrative embodiments have been described, it is evident that many alternatives, modifications, permutations and variations will become apparent to those skilled in the art in light of the foregoing description.

What is claimed is:

1. A gas seal column pump comprising a pump drive, a gas seal column, and a pump;

an auxiliary impellor coupled to a main impeller of said pump where said auxiliary impellor constitutes a hydrodynamic seal;

where a drive motor of the pump drive, the gas seal column, and the pump are sealed to one another to comprise a sealed, vertically-oriented, pumping system comprising a sealed pump envelope;

the drive motor that comprises a gas inlet pipe through which a seal gas is introduced into the drive motor;

where the seal gas is pressurized;

where the seal gas protects motor bearings and the interior of the drive motor by displacing corrosive fumes given off by a product that is being pumped;

where the seal gas exits from the drive motor via a plurality of gas outlet ports; and where the gas seal column encases a drive shaft between said drive motor and said pump within said sealed pump envelope and is operable to replace mechanical seals and packing seals around said drive shaft that couples the drive motor to the pump.

2. The gas seal column pump according to claim 1 where the gas seal column comprises an inlet pipe connection through which the seal gas enters the gas seal column;

where the seal gas comprises an outlet pipe connection through which the seal gas exits the gas seal column via a purge gas discharge valve;

where the seal gas within the gas seal column displaces the corrosive fumes and the product;

where pressure of the seal gas is increased and decreased to control a product level within the gas seal column.

3. The gas seal column pump according to claim 2 where the gas seal column comprises a plurality of level sensors which detect the product level within the gas seal column;

where the plurality of level sensors are positioned at differing heights within the gas seal column.

4. The gas seal column pump according to claim 3 where the plurality of level sensors comprise a first level sensor, a second level sensor, a third level sensor, and a fourth level sensor;

where the first level sensor is located at the lowest level of the gas seal column and above the lowest level of product needed for the pump to prime and when activated signals that the product has entered the gas seal column and the pump is primed for operation;

where the second level sensor is located above the first level sensor and when activated signals that an increase in the pressure of the seal gas is needed;

where the third level sensor is located above the second level sensor and when activated signals that a further increase in the pressure of the seal gas is needed and closes the purge gas discharge valve to further aid in increasing seal gas pressure;

where the fourth level sensor is located above the third level sensor and when activated initiates a controlled shutdown of the pump or the entire system.

5. The seal column pump according to claim 3 further comprising a seal gas control box to monitor the product level, to report the product level, and to control the product level and the continued operation of the pump;

where the seal gas control box monitors the product level via inputs from the plurality of level sensors.

6. The gas seal column pump according to claim 5 where the seal gas control box controls the product level by opening and closing a purge gas valve, a first gas valve, a second gas valve, the purge gas discharge valve, or combinations thereof.

7. The gas seal column pump according to claim 2 where the pump comprises, aft said auxiliary impellor coupled to said main impeller where said auxiliary impellor is larger in diameter than said main impeller;

where said auxiliary impellor is located closer to the gas seal column than said main impeller;

where said auxiliary impellor is operable as a hydrodynamic shaft seal to prevent the flow of the product into the gas seal column during pumping operations.

* * * * *